US010076693B2

(12) United States Patent
Long et al.

(10) Patent No.: US 10,076,693 B2
(45) Date of Patent: Sep. 18, 2018

(54) SPORTING-GOOD IMPLEMENT WITH ROTATABLE HANDLE

(71) Applicant: EASTON BASEBALL / SOFTBALL INC., Thousand Oaks, CA (US)

(72) Inventors: Keenan Long, Sherman Oaks, CA (US); Dewey Chauvin, Simi Valley, CA (US); Michael Lloyd Snow, Winnetka, CA (US); Ian Montgomery, Simi Valley, CA (US); Stephen J. Davis, Van Nuys, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 15/413,361

(22) Filed: Jan. 23, 2017

(65) Prior Publication Data

US 2017/0128799 A1 May 11, 2017

Related U.S. Application Data

(63) Continuation of application No. 13/958,309, filed on Aug. 2, 2013, now Pat. No. 9,586,111, which is a (Continued)

(51) Int. Cl.
*A63B 59/50* (2015.01)
*A63B 60/22* (2015.01)
(Continued)

(52) U.S. Cl.
CPC ..... *A63B 60/22* (2015.10); *A63B 59/50* (2015.10); *A63B 59/20* (2015.10); *A63B 2102/18* (2015.10); *A63B 2102/182* (2015.10)

(58) Field of Classification Search
CPC ..... A63B 2102/18; A63B 2102/182; A63B 59/50; A63B 59/51; A63B 59/54;
(Continued)

(56) References Cited

U.S. PATENT DOCUMENTS 1,305,952 A 6/1919 Suesman et al.
1,690,312 A 11/1928 Rosan
(Continued)

FOREIGN PATENT DOCUMENTS

CN 102274616 A 12/2011
JP 4870310 B2 2/2012
(Continued)

OTHER PUBLICATIONS

Taiwan Intellectual Property Office, Office Action and Search Report for TW103108700 with English translation, dated Jun. 9, 2017, 11 pgs.

(Continued)

*Primary Examiner* — Mark Graham
(74) *Attorney, Agent, or Firm* — Perkins Coie LLP

(57) ABSTRACT

A sporting-good implement, such as a ball bat or a lacrosse stick, includes a first handle section rotatably connected to a second handle section. The second handle section may be attached to or integral with a tapered region or barrel region of a ball bat, or with a shaft section or head of a lacrosse stick, or with another sporting-good feature. This rotatable engagement allows the relative position of the user's hands to change during the course of a swing, shot, or pass, ideally placing the user's hands in a position to generate improved power or control.

15 Claims, 6 Drawing Sheets

Related U.S. Application Data continuation-in-part of application No. 13/795,916, filed on Mar. 12, 2013, now Pat. No. 9,248,355.

(51) Int. Cl.
*A63B 102/18* (2015.01)
*A63B 59/20* (2015.01)

(58) Field of Classification Search
CPC ..... A63B 59/55; A63B 59/56; A63B 59/58; A63B 60/32
USPC ..... 473/457, 519, 520, 564–568, 513
See application file for complete search history.

(56) References Cited

U.S. PATENT DOCUMENTS

| | | | |
|---|---|---|---|
| 2,225,839 | A | 12/1940 | Moore |
| 2,471,610 | A | 5/1949 | Christensen et al. |
| 2,659,605 | A | 11/1953 | Letourneau |
| 3,624,881 | A | 12/1971 | Brown et al. |
| 3,804,413 | A | 4/1974 | Hrivnak et al. |
| 3,805,413 | A | 4/1974 | Burny et al. |
| 3,834,714 | A | 9/1974 | Smolinski et al. |
| 4,691,387 | A | 9/1987 | Lopez |
| 5,011,145 | A | 4/1991 | Bartkowicz |
| 5,035,428 | A | 7/1991 | Bartkowicz |
| 5,238,246 | A | 8/1993 | Erb et al. |
| 5,259,610 | A | 11/1993 | Erb et al. |
| 5,322,286 | A | 6/1994 | Frost |
| 5,342,046 | A | 8/1994 | Erb et al. |
| 5,482,270 | A | 1/1996 | Smith |
| 5,577,722 | A | 11/1996 | Glassberg |
| 5,588,651 | A | 12/1996 | Frost |
| 5,593,158 | A | 1/1997 | Filice et al. |
| 5,611,533 | A | 3/1997 | Williams et al. |
| 5,624,114 | A | 4/1997 | Kelsey |
| 5,704,845 | A | 1/1998 | Boyte et al. |
| 5,839,983 | A | 11/1998 | Kramer |
| 6,059,675 | A | 5/2000 | Finn |
| 6,260,198 | B1 | 7/2001 | Lomedico et al. |
| 6,277,040 | B1 | 8/2001 | Randolph et al. |
| 6,389,596 | B2 | 5/2002 | Lomedico et al. |
| 6,406,387 | B1 | 6/2002 | Ryan et al. |
| 6,427,246 | B1 | 8/2002 | Doi et al. |
| 6,752,731 | B1 | 6/2004 | Kramer et al. |
| 6,799,329 | B2 | 10/2004 | Lomedico et al. |
| 6,932,727 | B2 | 8/2005 | Kramer et al. |
| 6,996,849 | B2 | 2/2006 | Lomedico et al. |
| 7,115,054 | B2 | 10/2006 | Giannetti et al. |
| 7,220,195 | B1 | 5/2007 | Cronin et al. |
| 7,484,248 | B2 | 2/2009 | Lomedico et al. |
| 7,572,198 | B2 | 8/2009 | Bleecker et al. |
| 8,167,744 | B2 | 5/2012 | Silvain et al. |
| 8,182,361 | B2 | 5/2012 | Gill et al. |
| 9,155,951 | B2 | 10/2015 | Ahern et al. |
| 9,248,355 | B2 * | 2/2016 | Long ..... A63B 60/10 |
| 9,586,111 | B2 * | 3/2017 | Long ..... A63B 60/32 |
| 2003/0013563 | A1 | 1/2003 | Ryan et al. |
| 2003/0144089 | A1 | 7/2003 | Ryan et al. |
| 2004/0048696 | A1 | 3/2004 | Ciesar et al. |
| 2004/0224804 | A1 | 11/2004 | Estape et al. |
| 2005/0272537 | A1 | 12/2005 | Kramer et al. |
| 2008/0085792 | A1 | 4/2008 | Sims et al. |
| 2008/0220914 | A1 | 9/2008 | Shaw et al. |
| 2009/0312125 | A1 | 12/2009 | Kearns et al. |
| 2012/0135826 | A1 | 5/2012 | Carlson et al. |
| 2013/0036528 | A1 | 2/2013 | Wilson et al. |
| 2013/0196769 | A1 | 8/2013 | Shocklee et al. |
| 2013/0196796 | A1 | 8/2013 | Johnson et al. |
| 2014/0274491 | A1 | 9/2014 | Long et al. |
| 2014/0274497 | A1 | 9/2014 | Long et al. |

FOREIGN PATENT DOCUMENTS

| | | | |
|---|---|---|---|
| WO | 1993017855 | A1 | 9/1993 |
| WO | 1995019821 | A1 | 7/1995 |

OTHER PUBLICATIONS

State Intellectual Property Office, China, Second Office Action for CN201480014867.0, with English translation, dated May 2, 2017, 19 pgs.
State Intellectual Property Office, China, First Office Action for CN201480014867.0, with English translation, dated Jul. 26, 2016, 17 pgs.
State Intellectual Property Office, China, First Office Action for CN201480014841.6, with English translation, dated Jul. 29, 2016, 21 pgs.
USPTO, Final Office Action for U.S. Appl. No. 13/958,309, dated Feb. 3, 2016, 4 pgs.
USPTO, Final Office Action for U.S. Appl. No. 14/313,186, dated Feb. 3, 2016, 5 pgs.
USPTO, Final Office Action for U.S. Appl. No. 13/795,916, dated May 11, 2015, 5 pgs.
USPTO, International Search Report and Written Opinion for PCT/US2015/037485, dated Sep. 16, 2015, 7 pgs.
USPTO, International Search Report and Written Opinion for PCT/US2014/022802, dated Jul. 1, 2014, 8 pgs.
USPTO, International Search Report and Written Opinion for PCT/US2014/022794, dated Jul. 1, 2014, 8 pgs.
USPTO, Non-Final Office Action for U.S. Appl. No. 13/795,916, dated Jan. 23, 2015, 6 pgs.
USPTO, Non-Final Office Action for U.S. Appl. No. 13/795,916, dated Sep. 29, 2015, 4 pgs.
USPTO, Non-Final Office Action for U.S. Appl. No. 13/958,309, dated Jul. 27, 2015, 6 pgs.
USPTO, Non-Final Office Action for U.S. Appl. No. 13/958,309, dated Jul. 13, 2016, 6 pgs.
USPTO, Non-Final Office Action for U.S. Appl. No. 14/313,186, dated Aug. 12, 2015, 8 pgs.

* cited by examiner

SPORTING-GOOD IMPLEMENT WITH ROTATABLE HANDLE

PRIORITY CLAIM

This application is a continuation of U.S. patent application Ser. No. 13/958,309, filed Aug. 2, 2013 and now pending, which is a continuation-in-part of U.S. patent application Ser. No. 13/795,916, filed Mar. 12, 2013 and issued as U.S. Pat. No. 9,248,355, each of which is incorporated herein by reference.

BACKGROUND

Baseball and softball batters often experience fatigue in their forearms after swinging a bat several times over a short interval. A force analysis indicates that this fatigue at least partially results from the bottom hand and the top hand opposing each other during the swing. In general, the bottom hand generally performs a pulling motion while the top hand generally performs a pushing motion. During the initial stages of the swing, as the bottom hand pulls and the top hand pushes, the barrel of the bat begins to descend into the plane of the pitched (or stationary) ball. During this time, the hands ideally rotate into the proper "power position," in which the palm of the lower hand generally faces downward while the palm of the upper hand generally faces upward. There may be some variance due to differing pitch locations but, regardless, in the power position the two palms should generally face opposite directions while being essentially coplanar. To accomplish this hand-positioning, most batters need to rotate one or both of their hands during the swing.

SUMMARY

A sporting-good implement, such as a ball bat or a lacrosse stick, includes a first handle section rotatably connected to a second handle section. The second handle section may be attached to or integral with a tapered region or barrel region of a ball bat, or with a shaft section or head of a lacrosse stick, or with another sporting-good feature. This rotatable engagement allows the relative position of the user's hands to change during the course of a swing, shot, or pass, ideally placing the user's hands in a position to generate improved power or control. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Figure 1:
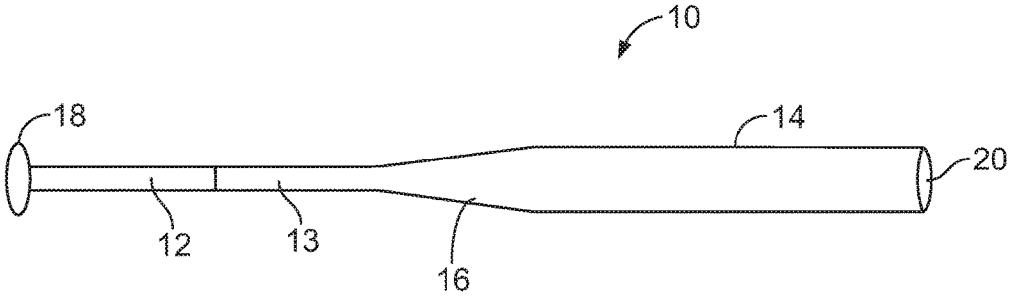
FIG. 1 is a perspective view of a ball bat including a rotatable handle, according to one embodiment.

While the concepts described herein may be utilized in a variety of sporting-good implements, such as ball bats, lacrosse sticks, and hockey sticks, for ease of description, a ball bat primarily will be described. Turning now in detail to the drawings, as shown in FIG. 1, a baseball or softball bat 10, hereinafter collectively referred to as a "ball bat" or "bat," includes a first handle section 12 rotatably engaged with a second handle section 13. A grip made of rubber, tape, foam, or of another suitable material may be positioned over one or both of the first and second handle sections 12, 13. In one embodiment, separate grips are positioned on the first and second handle sections 12, 13 so that they do not hinder relative rotation between the handle sections 12, 13.

A tapered section 16 of the bat 10 joins the second handle section 13 to a barrel 14. A radially outer surface of the tapered section 16 preferably is flush and continuous with the radially outer surfaces of the second handle section 13 and the barrel 14. The second handle section 13, the tapered section 16, and the barrel 14 may be integral or may include two or more separate pieces attached to each other, as described, for example, in U.S. Pat. No. 5,593,158, which is incorporated herein by reference.

The free end of the first handle section 12 includes a knob 18 or similar structure. The barrel 14 is preferably closed off by a suitable cap 20 or plug. The interior of the bat 10 is preferably substantially hollow, allowing the bat 10 to be relatively lightweight so that ball players may generate substantial bat speed when swinging the bat 10. While the handle sections in several of the drawings are shown to be solid, the handle sections also may be hollow.

The bat barrel 14 preferably is constructed from one or more metal, plastic, or composite materials that are co-cured during the barrel molding process. Some examples of suitable materials include aluminum, titanium, ABS plastic, carbon, glass, graphite, boron, aramid, ceramic, Kevlar, or Astroquartz®. The handle sections 12, 13 may be constructed from the same material as, or different materials than, the barrel 14. For example, the handle sections 12, 13 may be constructed from a composite material, a plastic material, a metal material, or any other suitable material. Further, in some embodiments, the first handle section 12 may be made of a different material than the second handle section 13.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference. An ISCZ may include, for example, a disbonding layer or other element, mechanism, or space suitable for preventing transfer of shear stresses between neighboring barrel walls. A disbonding layer or other ISCZ preferably further prevents neighboring barrel walls from bonding to each other during curing of, and throughout the life of, the ball bat 10.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The first handle section 12 of the ball bat 10 may be attached to the second handle section 13 in any manner that securely connects—and provides relative rotation between—the two handle sections. The first handle section 12 is generally intended to be gripped by a user's bottom or non-dominant hand, while the second handle section 13 is generally intended to be gripped by the user's upper or dominant hand. In one embodiment, the first handle section 12 extends approximately three to six inches from the knob 18, and the second handle section 13 extends approximately three to ten inches from the first handle section 12, or the second handle section 13 is integral with the tapered section 16 (if included) or the barrel 14. Any other suitable handle-section lengths may alternatively be used. Examples of suitable connections between the first and second handle sections 12, 13 in a ball bat 10 are shown in FIGS. 2-7 (with different reference numbers used to identify the handle sections to reflect the differences between the illustrated embodiments).

Figure 2:
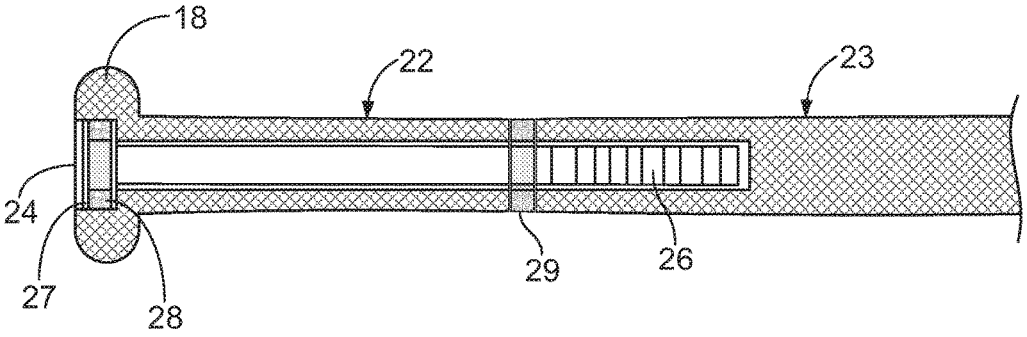
FIG. 2 is a cross-sectional view of the rotatable handle region of a ball bat, according to one embodiment.

In the embodiment shown in FIG. 2, the first handle section 22 is connected to the second handle section 23 via a bolt 24 or other threaded connector. The bolt 24 is inserted through a plate 27 or similar mounting structure at the lower end of the first handle section 22. The external threads 26 of the bolt engage matching internal threads of the second handle section 23 to secure the first and second handle sections 12, 13 to each other. The internal threads may be part of the second handle section 23 itself, or may be included in a separate insert, such as a threaded metal insert that is molded with—or otherwise affixed to—the radially inner surface of the second handle section 23.

The bolt 24 passes through a first spacer or bearing member 28 positioned in or near the knob 18 of the ball bat 10, and a second spacer or bearing member 29 positioned between the first and second handle sections 22, 23. The first and second bearing members 28, 29 optionally include grooves or other bearing tracks along which the handle sections may rotate. This bearing arrangement provides full 360-degree rotation between the first and second handle sections 22, 23.

The first and second bearing members 28, 29 may be made of a metal material, such as aluminum, or of a composite material, such as glass-reinforced polycarbonate, or of another suitable material. While two bearing members are shown in the illustrated embodiment, any other suitable number of bearing members—arranged to provide relative rotation between the first and second handle sections 22, 23—may be utilized. In one embodiment, for example, a single bearing member extending the length of the first handle section 22 may be used to facilitate rotation between the first and second handle sections 22, 23.

Figure 3:
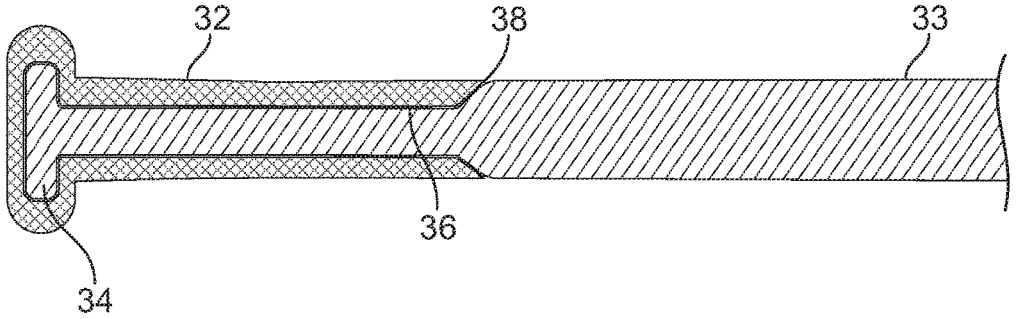
FIG. 3 is a cross-sectional view of the rotatable handle region of a ball bat, according to another embodiment.

In the embodiment shown in FIG. 3, the first handle section 32 is positioned over the second handle section 33, including over the knob region 34 of the second handle section 33. The knob region 34 prevents longitudinal slippage of the first handle section 32. In one version of this embodiment, the first handle section 32 is made of a composite or plastic material, while the second handle section 33 is made of a composite or metal material.

The outer diameter of the portion of the second handle section 33 that resides within the first handle section 32 is reduced relative to the diameter of the portion of the second handle section 23 that extends away from the first handle section 22. The outer diameter of this extending region of the second handle section 33 preferably is equal to, or substantially equal to, the outer diameter of the first handle section 32 so that the longitudinally neighboring outer surfaces of the first and second handle sections 32, 33 are continuous and flush with each other.

A low-friction release ply 36, such as a layer of polytetrafluoroethylene (Teflon®) or another ISCZ, is positioned between the first and second handle sections 32, 33 to facilitate rotation between them. The release ply alternatively may be made of a higher-friction material if a greater resistance to rotation is desired. The release ply preferably has a thickness of approximately 0.002 to 0.010 inches. Any other suitable thickness may alternatively be utilized.

In one embodiment, the release ply 36 completely isolates the first and second handle sections 32 from each other such that they are free to rotate a full 360 degrees about the release ply 36. In an alternative embodiment, the first and second handle sections 32, 33 may be molded together as a unitary construction or may otherwise be connected or merged at a longitudinal interface region 38, or at another suitable region, in a manner that allows for only limited relative rotation between them.

For example, one or more composite plies including fibers oriented at zero degrees relative to the longitudinal axis of the ball bat may be used to construct both the first and second handle sections 32, 33 (or portions thereof). Plies oriented in this manner would act essentially as a composite torsion spring that facilitates a limited amount of rotation between the first and second handle sections 32, 33 during a swinging motion, while "snapping" the bat back into its initial alignment after the swing is completed.

Figure 4:
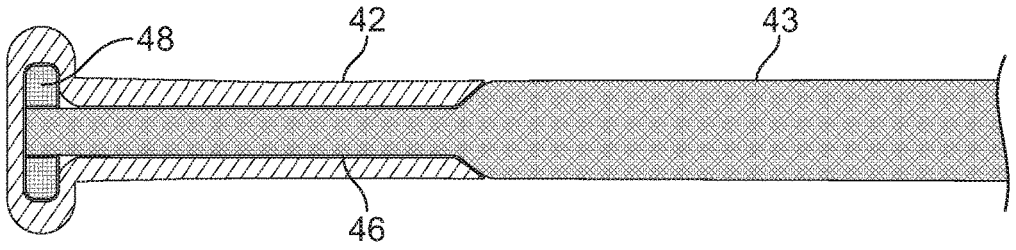
FIG. 4 is a cross-sectional view of the rotatable handle region of a ball bat, according to another embodiment.

In the embodiment shown in FIG. 4, a bearing 48 is included in addition to a release ply 46 to provide rotation between the first and second handle sections 42, 43. One or more additional bearings optionally may be included, as well. Depending on the materials used, including one or more bearings may facilitate less restricted rotation relative to a ball bat including only a release ply between the first and second handle sections.

Figure 5:
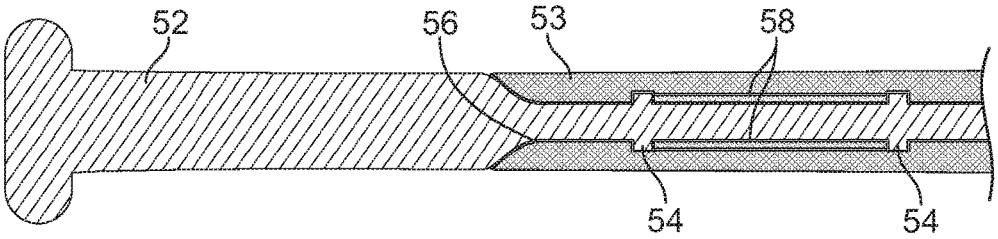
FIG. 5 is a cross-sectional view of the rotatable handle region of a ball bat, according to another embodiment.

In the embodiment shown in FIG. 5, the first handle section 52 extends inside of the second handle section 53. The first handle section 52 includes one or more radially outward projections 54 that engage an interior region of the second handle section 53 to prevent, or substantially prevent, the first handle section 52 from pulling out of the second handle section 53. Two of these projections are included in the illustrated embodiment but any other suitable number may be used.

To attain this configuration, the first and second handle sections 52, 53 are preferably made of composite materials or other moldable materials that may be laid up together and co-molded into a hardened configuration. One or more release plies 56, bearings 58, or both, are included between the first and second handle sections 52, 53 to facilitate rotation between them. In an alternative embodiment, the second handle section 53 may include one or more radially inward projections that engage an exterior region of the first handle section 52 to prevent, or substantially prevent, the first handle section 52 from pulling out of the second handle section 53.

Figure 6:
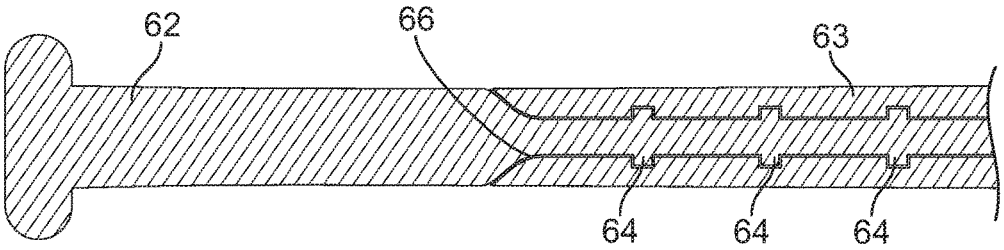
FIG. 6 is a cross-sectional view of the rotatable handle region of a ball bat, according to another embodiment.

The embodiment shown in FIG. 6 is similar to the embodiment shown in FIG. 5 except that the bearing is omitted and a third radially outward projection 64 is included between the first and second handle sections 62, 63. A release ply 66 is included between the first and second handle sections 62, 63 to facilitate rotation between them.

Figure 7:
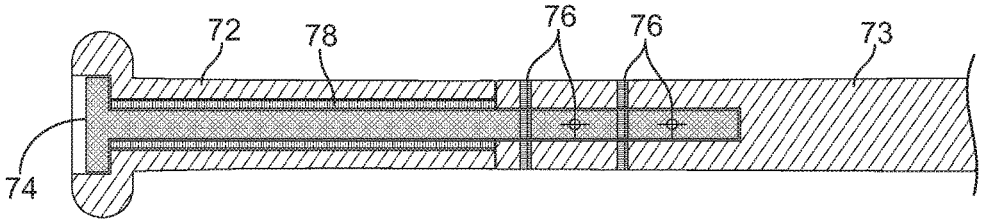
FIG. 7 is a cross-sectional view of the rotatable handle region of a ball bat, according to another embodiment.

In the embodiment shown in FIG. 7, a bolt 74 is inserted into the first handle section 72 and threaded into receiving threads in the second handle section 73, similar to the configuration shown in FIG. 2. One or more pins 76 (four pins are shown in the illustrated embodiment) may be used to provide additional strength to the connection between the bolt 74 and the second handle section 73. The pins 76 pass through openings in the second handle section 73 and the bolt 74 to further secure them together. At least one bushing 78 is positioned between the bolt 74 and the first handle section 72 to provide rotation of the first handle section 72 around the bolt 74 (and, thus, relative rotation between the first and second handle sections 72, 73).

Figure 9:
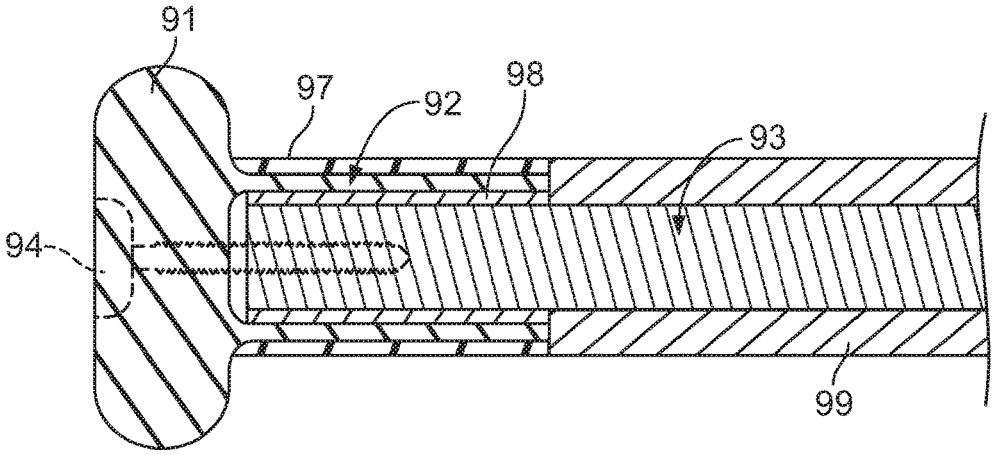
FIG. 9 is a cross-sectional view of the rotatable handle region of a ball bat, according to another embodiment.

In the embodiment shown in FIG. 9, the first handle section 92 includes a knob 91 or similar end-closure element. The inner surface of the first handle section 92 is positioned over the outer surface of the second handle section 93 and is attached to the second handle section 93 via a bolt 94 or other suitable connector. One or more bushings 98, bearings, or low-friction materials, such as a release ply, may be positioned between the first and second handle sections 92, 93 to provide rotation between them, as described above.

This configuration could be applied to existing bats by cutting off a portion of the handle including the knob, drilling away material from the inner surface of the handle and the knob, then sliding the newly created "handle-knob," or first handle section 92, over the outer diameter of the second handle section 93. Alternatively, the knob could be cut off of an existing bat and a first handle section 92 having an inner diameter large enough to slide over the outer diameter of the second handle section 93 may be positioned over the second handle section 93. In either of these embodiments, the first handle section 92 may then be secured to the second handle section 93 via a bolt 94 or other suitable connector.

While the first and second handle sections 92, 93 will have different outer diameters in this embodiment, a uniform outer diameter may be achieved by using multiple grips having different thicknesses. For example, if the outer diameter of the first handle section 92 is 0.25 inches greater than that of the second handle section 93, a first grip 97 could be positioned on the first handle section 92 and a second grip 99—having a thickness that is approximately 0.25 inches greater than that of the first grip—could be positioned on the second handle section 93. Alternatively, a single grip having a uniform thickness, or multiple grips having the same thickness, may be positioned on the first and second handle sections 92, 93 if varying grip diameters are desired.

Figure 10:
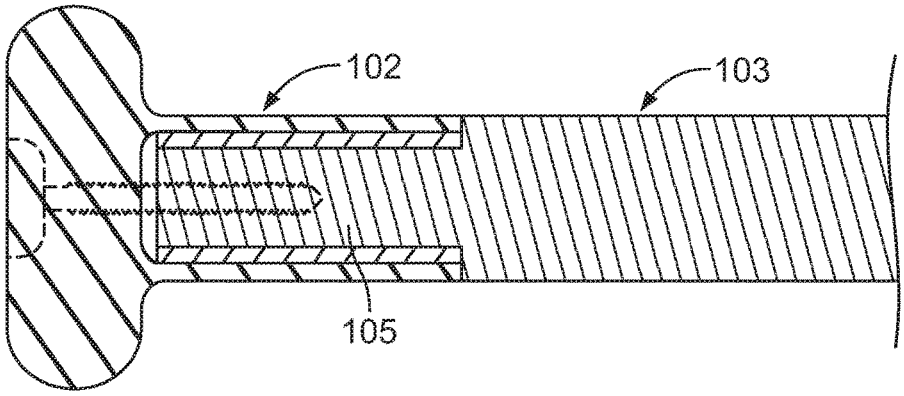
FIG. 10 is a cross-sectional view of the rotatable handle region of a ball bat, according to another embodiment.

The embodiment shown in FIG. 10 is similar to the embodiment shown in FIG. 9 except that the second handle section 103 includes a reduced diameter region 105 over which the first handle section 102 is positioned. This allows the external outer diameters of the first and section handle sections 102, 103 to be equal, such that a single grip of uniform thickness may be positioned over the first and second handle sections 102, 103.

Figure 11:
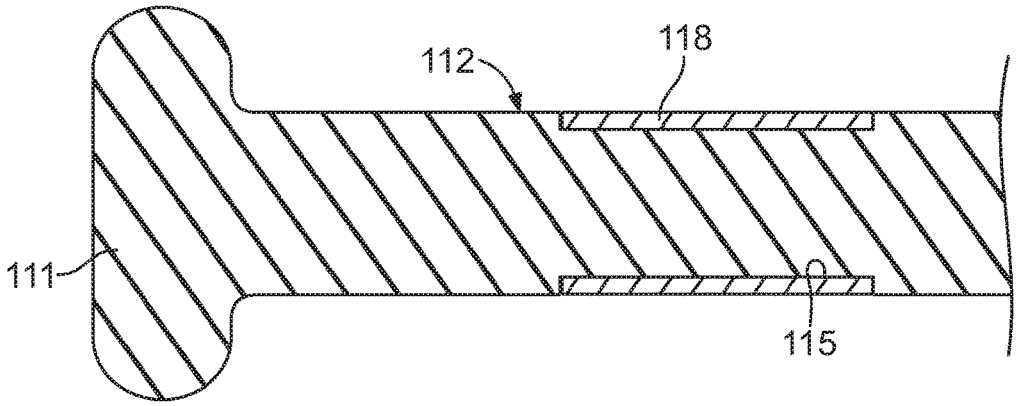
FIG. 11 is a cross-sectional view of the rotatable handle region of a ball bat, according to another embodiment.

In the embodiment shown in FIG. 11, the bat handle 112 does not include multiple handle sections. The handle 112, however, includes a reduced diameter region, such as an annular recess 115, over which a low-friction tube, sleeve 118, or other rotatable element is positioned. The sleeve 118 may be made of Teflon® or of a similar low-friction material to provide rotation of the sleeve relative to the bat handle 112. Alternatively, the sleeve 118 may be made of a plastic, metal, or composite material and may include a low-friction coating, such as Teflon®, or a lubricant, such as grease, on an inner surface of the sleeve 118.

The outer diameter of the sleeve 118 optionally is equal to, or substantially equal to, the outer diameter of the one or more neighboring handle regions. The recess 115 and sleeve 118 may be sized and positioned to provide rotation for the user's upper hand, lower hand, or both. In one embodiment, for example, the reduced diameter region 115 and the sleeve 118 may extend all the way to the knob 111 to provide rotation for both of the user's hands.

The sleeve 118 may include a slit to facilitate its placement over the handle 112. Alternatively, the sleeve 118 may be formed of two or more pieces that are connected to each other—via bonding, stitching, welding, or another suitable method—after they are positioned in the recess 115. A flexible grip may be positioned over the handle, including the sleeve 118, such that the portion of the grip positioned over the sleeve 118 may rotate with the sleeve 118.

Figure 12:
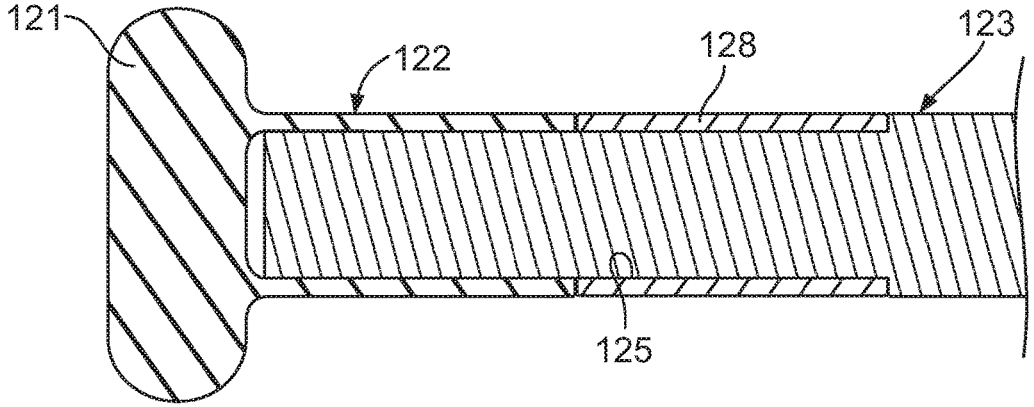
FIG. 12 is a cross-sectional view of the rotatable handle region of a ball bat, according to another embodiment.

In the embodiment shown in FIG. 12, the second handle section 123 includes a reduced diameter region or recess 125 to which the first handle section 122 is fixed via bonding, pins, or other suitable connectors. The first handle section 122 includes a knob 121 or similar end-closure element. A low-friction tube or sleeve 128, similar to the sleeves described in the embodiment shown in FIG. 11, is positioned over the recess 125 to provide rotation for one or both of a user's hands.

In this embodiment, a one-piece tube or sleeve—which does not include a slit or opening—may be used, since it can be positioned over the recess 125 before the first handle section 122 is attached to the recessed end of the second handle section 123. Alternatively, a multi-piece sleeve, or a sleeve with a slit, may be used and installed before or after the first handle section 122 is attached to the second handle section 123.

While in several embodiments described above the second handle section includes a reduced diameter region over which the first handle section is positioned, these configurations could be reversed such that the first handle section includes a reduced-diameter region over which the second handle section is positioned. Thus, the illustrated embodiments are only exemplary in nature.

In another embodiment, the first handle section may include a portion with a reduced or tapered diameter that is inserted into a separate second handle section. Alternatively, the second handle section may have a portion with a reduced or tapered diameter that is inserted into a separate first handle section. Grooves or a similar bearing system, or one or more release plies, may be provided between the first and second handle sections to facilitate rotation up to 360 degrees between the two handle sections.

In another embodiment, the first handle section is connected to the second handle section via a rotatable sleeve. The sleeve may provide the only connection between the first and second handle sections, or one or more additional connection mechanisms may be used. The sleeve may be connected inside the first and second handle sections, or outside both of them, or inside one of them and outside the other. In one version of this embodiment, the sleeve may be made of a rubbery or otherwise elastic material that allows it to recoil to its original, pre-swing position after a swing.

In another embodiment, the torque rate required to induce rotational motion between the first and second handle sections may be adjustable to meet a given user's needs. The required torque may be adjusted by tightening or loosening a bolt that connects the two handle sections, for example, via an Allen wrench or other tool. The torque rate required to induce rotation may be adjusted so high that the first and second handle sections do not rotate at all during a typical swing, thus effectively deactivating the rotation feature. Conversely, the torque rate required to induce rotation may be adjusted so low that the first and second handle sections will rotate in response to minimal force.

In another embodiment, a torsion spring or rotary spring may be attached to or integrally molded with interior portions of the first and second handle sections to control the amount of rotation between them. While including a separate spring adds some weight to the bat, such a self-realigning feature also provides a degree of rotational resistance that is felt by the user. This resistance may provide useful feedback to the user regarding proper hand alignment. For example, if a user experiences an extreme amount of resistance, he or she may determine that it would be advantageous to alter the initial hand positions on the ball bat.

Various ranges of motion may be preferred by different types of hitters. For example, a "contact hitter," such as a typical leadoff hitter, may exhibit a controlled swing in which his or her hands rotate approximately 15-30° during a typical swing. More powerful hitters, conversely, may rotate their hands approximately 30-90° during a typical swing, or even 90-180° degrees during a particularly powerful swing. Providing rotating handle sections in the ball bat, such that the hitter's hands rotate along with, as opposed to relative to, the bat handle, facilitates the generation of increased hitting power in a shorter path to the ball than that generally produced by a conventional ball bat.

In use, a ball bat constructed according to the above embodiments facilitates a level swing that keeps the hitting surface of the bat in the hitting zone for an extended period of time. Because the bat itself rotates, the user's hands do not need to rotate relative to the bat, thus allowing the user's hands to exert increased force in a shorter path in the direction of the swing. Put another way, when the user's arms begin to extend toward the pitcher, the rotatable handle allows the user's hands to reach the power position without active effort from the user. Further, because the structural handle sections of the bat rotate relative to each other, there is no need for additional, less durable rotating mechanisms, such as rotatable grip members.

The margin of error for the timing of a swing at a pitched ball also may be increased due to inclusion of rotating handle sections. Indeed, the bat barrel generally is able to arrive in the plane of the pitch more quickly because the hitter's hands do not need to rotate around the handle. Thus, the barrel remains in the hitting plane for a longer period of time and faster bat speed may be generated. Further, fewer unintended ground balls may be hit because the user is able to keep the bat in the hitting zone longer without rolling over the hands, particularly when swinging at a low pitch or an off-speed pitch. In addition, the user can get the barrel of the bat into the hitting zone more quickly when swinging late on a difficult to hit inside pitch. Thus, the hitter is more likely to make solid contact on various pitches.

As noted above, the concepts described herein may be applied to other sporting-good implements, as well. The various rotatable handle features described above may be used, for example, in a lacrosse-stick shaft, a hockey-stick shaft, and so forth. Additional or alternative features may also be included in these types of items. For ease of description, a lacrosse-stick shaft will be described below with regard to these additional features.

Figure 8:
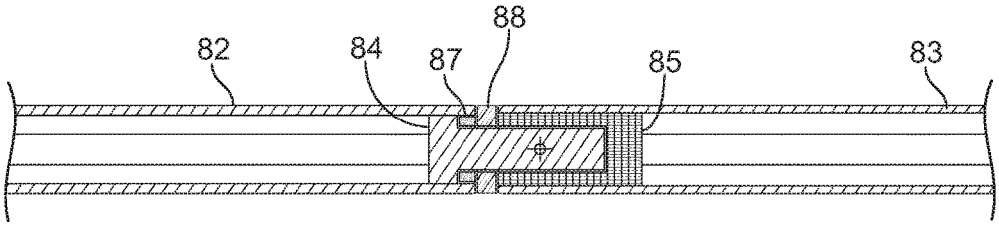
FIG. 8 is a cross-sectional view of the rotatable handle region of a lacrosse shaft, according to one embodiment.

In the embodiment shown in FIG. 8, a first handle section or shaft section 82 of a lacrosse stick is connected to a second handle section or shaft section 83 of the lacrosse stick via a bolt 84 or other suitable connector. The bolt is inserted into the first shaft section 82 and threaded into receiving threads in the second handle section 83. The receiving threads may be located in the interior surface of the second shaft section 83, or a separate insert or receiving element 85 including internal threads, such as urethane potting or another suitable component, may be positioned within the second shaft section 83 for receiving the bolt 84.

A bearing 88 or similar spacer is positioned between the first and second shaft sections 82, 82 to provide rotation between them. A washer 87 or similar element may be included between the head of the bolt 84 and the bearing 88 to provide a secure connection and to prevent the bolt from damaging the bearing 88.

In one embodiment, a quick-release mechanism—which allows a player to rotate the lacrosse-stick shaft between a ball-cradling position and a shooting position—may be included in the lacrosse shaft. The quick-release mechanism may be operated via a button, switch, or similar actuator positioned on or in the shaft that facilitates relative rotation of the first and second handle sections when actuated.

In another embodiment, the first and second handle or shaft sections of the lacrosse-stick shaft may have differing external shapes, thus allowing a user to identify which section he or she is gripping without looking at the shaft. The first shaft section, for example, may have a circular or elliptical cross section, while the second shaft section may have an octagonal cross section. Any other suitable shapes or combinations of shapes may alternatively be used.

The first or lower shaft section in the lacrosse-stick shaft may have a variety of lengths, depending on the preferences of a given user. Thus, the connection point between the first and second shaft sections may be located near the bottom of the shaft away from the lacrosse head, or approximately at the midpoint of the shaft, or near the top of the shaft adjacent to the head, and so forth.

In one embodiment, the rotation-facilitating mechanism may also provide increased or varied shaft flexion, such as when an elastic connector is used to provide rotation. Additionally or alternatively, the lower and upper shaft sections may have differing stiffness properties or flexion profiles. In one version of this embodiment, the lower shaft section may be stiffer than the upper shaft section to provide enhanced performance or "whip" when shooting or passing a lacrosse ball.

Any of the above-described embodiments may be used alone or in combination with one another, and elements of certain embodiments may interchanged with those of other embodiments. For example, where applicable, bearings may be used in place of bushings, and vice versa, pins may be added or omitted, and so forth. Further, the sporting-good implements may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A sporting good implement, comprising:

a first handle section having a first region including a first outer diameter, and a second region having a second outer diameter that is less than the first outer diameter;

a second handle section having a third outer diameter that is substantially equal to the first outer diameter, wherein the second handle section is positioned over the second region of the first handle section;

a low-friction element positioned between the first handle section and the second handle section; and a main body attached to or integral with the second handle section; wherein the first handle section rotates relative to the main body and the second handle section.

2. The sporting good implement of claim 1 wherein the first handle section comprises a knob positioned on a free end of the sporting good implement and the main body comprises a bat barrel positioned opposite the knob.

3. The sporting good implement of claim 1 wherein the first handle section is rotatably engaged with the second handle section via at least one bearing.

4. The sporting good implement of claim 1 wherein the second region of the first handle section comprises at least one radially outward projection positioned to engage an interior region of the second handle section.

5. The sporting good implement of claim 1 wherein the second handle section comprises at least one radially inward projection positioned to engage the second region of the first handle section.

6. The sporting good implement of claim 1, further comprising a first grip element positioned on the first handle section and a second grip element separate from the first grip element and positioned on the second handle section.

7. The sporting good implement of claim 1 wherein the main body comprises a portion of a lacrosse stick.

8. The sporting good implement of claim 1, further comprising a spring element attached to the first and second handle sections and configured to provide rotational resistance.

9. A ball bat, comprising:

a first handle section comprising a knob positioned on a free end of the ball bat, the first handle section having a first region including a first outer diameter, and a second region having a second outer diameter that is less than the first outer diameter;

a second handle section having a third outer diameter that is greater than the second outer diameter, wherein the second handle section is positioned over the second region of the first handle section;

a barrel; and a tapered section joining the barrel to the second handle section; wherein the barrel and the second handle section rotate freely relative to the first handle section.

10. The ball bat of claim 9 wherein the second handle section is rotatably engaged with the second region of the first handle section via at least one bearing or release ply.

11. The ball bat of claim 9 wherein a low-friction element is positioned between the first handle section and the second handle section.

12. The ball bat of claim 9 wherein at least one of the second region or the second handle section comprises at least one radial projection configured to engage the other of the second region or the second handle section to resist the second handle section pulling away from the first handle section.

13. The ball bat of claim 9, further comprising a first grip element positioned on the first handle section and a second grip element separate from the first grip element and positioned on the second handle section.

14. The ball bat of claim 9 wherein a radially outer surface of the first handle section is flush with a radially outer surface of the second handle section.

15. A sporting good implement, comprising:

a first handle section having a first region including a first outer diameter, and a second region having a second outer diameter that is less than the first outer diameter;

a second handle section having a third outer diameter that is substantially equal to the first outer diameter, wherein the second handle section is positioned over the second region of the first handle section; and a main body attached to or integral with the second handle section; wherein the first handle section rotates freely relative to the main body and the second handle section.

* * * * *